US011162653B2

(12) United States Patent
Grave et al.

(10) Patent No.: US 11,162,653 B2
(45) Date of Patent: Nov. 2, 2021

(54) MODULAR LED STRING

(71) Applicant: Lumileds LLC, San Jose, CA (US)

(72) Inventors: Manuel Grave, Aachen (DE); Nikolai Timm, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/810,659

(22) Filed: Mar. 5, 2020

(65) Prior Publication Data

US 2020/0284403 A1 Sep. 10, 2020

(30) Foreign Application Priority Data

Mar. 6, 2019 (EP) ..... 19161034

(51) Int. Cl.

| | |
|---|---|
| ***F21S 4/24*** | (2016.01) |
| ***H05B 45/30*** | (2020.01) |
| ***F21V 23/00*** | (2015.01) |
| ***F21V 23/06*** | (2006.01) |
| *F21Y 115/10* | (2016.01) |

(52) U.S. Cl.

CPC ..... *F21S 4/24* (2016.01); *F21V 23/005* (2013.01); *F21V 23/06* (2013.01); *H05B 45/30* (2020.01); *F21Y 2115/10* (2016.08)

(58) Field of Classification Search

CPC ..... F21S 4/24; H05B 45/30; F21V 23/005; F21V 23/06

See application file for complete search history.

(56) References Cited

U.S. PATENT DOCUMENTS 4,994,944 A * 2/1991 Vernondier ..... E04F 19/061 362/219
10,487,995 B2 11/2019 Qiu et al.
2006/0284199 A1 12/2006 Matheson
(Continued)

FOREIGN PATENT DOCUMENTS

DE 102013211457 A1 12/2014
FR 3048056 A1 8/2017

OTHER PUBLICATIONS

"European Application Serial No. 19161034.4, extended European Searh Report dated Aug. 23, 2019", 8 pgs.
(Continued)

*Primary Examiner* — Anabel Ton
(74) *Attorney, Agent, or Firm* — Schwegman Lundberg & Woessner, P.A.

(57) ABSTRACT

A modular LED string, an LED lighting assembly containing the LED string, and a method of manufacturing the lighting assembly are described. In various embodiments, the LED string contains LED module groups mounted on a carrier. Each module group has a series-connected row of LED modules, commencing with a first LED module followed by at least one inner LED module and terminated by a final LED module. Each main contact pad is electrically connected to a main supply track formed on the carrier and is arranged between neighbouring modules. Each secondary contact pad is electrically connected to a secondary supply track formed on the carrier and is arranged on either side of an inner module. An anode contact of each first module is electrically connected to the main supply track, and an anode contact of each remaining module is electrically connected to a secondary supply track.

17 Claims, 5 Drawing Sheets

(56) References Cited

U.S. PATENT DOCUMENTS

| | | | | |
|---|---|---|---|---|
| 2010/0061095 | A1* | 3/2010 | Hoffmann | F21S 8/022<br>362/235 |
| 2012/0326634 | A1 | 12/2012 | Li | |
| 2015/0092413 | A1 | 4/2015 | Li et al. | |
| 2018/0031217 | A1* | 2/2018 | Tuchler | F21V 23/02 |
| 2019/0032870 | A1 | 1/2019 | Qiu et al. | |

OTHER PUBLICATIONS

"International Application Serial No. PCT/EP2020/055022, International Search Report dated May 8, 2020", 5 pgs.
"International Application Serial No. PCT/EP2020/055022, Written Opinion dated May 8, 2020", 6 pgs.

* cited by examiner

MODULAR LED STRING

PRIORITY

This application claims the benefit of priority to EP 19161034.4, filed Mar. 6, 2019, which is incorporated herein by reference in its entirety.

TECHNICAL FIELD

The present disclosure is related to a modular light-emitting diode (LED) string, an LED lighting assembly, and a method of manufacturing an LED lighting assembly.

BACKGROUND

With advances in the manufacture of LEDs, their use in lighting applications such as automotive lighting has become widespread. Such lighting applications are subject to many constraints, including the desire to suit design goals. For this reason, the concept of a modular LED string having multiple LEDs soldered to a flexible carrier was developed. Examples of a modular LED string are given in US2015/0092413A1 and in FR3048056A1. In such a modular LED string, complete groups of series-connected LEDs can be cut from the modular LED string. To facilitate this, the first LED of each group is arranged for connection to a power supply, and the final LED of each group is arranged for connection to ground. Suitable conductive tracks for the power supply and for ground can run the length of the carrier. The number of inner LEDs between the first and final LED of a series-connected group is limited to limit the LEDs in series. The advantage of such an approach is that, regardless of how many such groups are present on a string (after cutting a section of complete groups from the string), the anodes of all first LEDs of the groups can be connected to a common power supply, and the cathodes of all final LEDs of the groups can be connected to common ground.

Each LED of a group therefore has specific connection requirements, e.g., the cathode of the first LED must be connected to the anode of the second LED; the cathode of the final LED must be connected to ground, etc. For ease of manufacturing, an LED may be provided on a small printed circuit board (PCB) with contact pads on its underside. The contact pads of such an LED module are formed according to the intended position of the LED module in a series-connected string.

A driver (for supplying power to the modular LED string) therefore also only uses one voltage output for connection to the corresponding supply voltage track on the carrier, and a return or ground terminal for connection to the corresponding return track on the carrier.

While the modular LED string described above has advantages, it also suffers from at least one limitation. This is because of the specific connection requirements of the LEDs of a series-connected group as described above. These connection requirements mean that such a modular LED string can only be cut between complete groups. Therefore, if a series-connected LED group has a certain module length (e.g., 30 mm for three LEDs in a group), the length of a string section cut from that modular LED string will always be a multiple of that module length (e.g., 12 cm in the case of four 30 mm groups).

However, certain design requirements may specify a different LED string length (e.g., 10 cm). To achieve "non-standard" lengths, corrective circuitry or a supplemental LED circuit portion is added to obtain the desired number of LEDs and/or the desired string length. However, these modifications are time-consuming and costly.

SUMMARY

In some embodiments, the modular LED string comprises a plurality of LED module groups mounted on a carrier, wherein an LED module group comprises a series-connected row of three or more LED modules commencing with a first LED module followed by a number of inner LED modules and terminated by a final LED module. The modular LED string features a plurality of main contact pads, each of which can be used to make an electrical connection to a driver, wherein each main contact pad is electrically connected to a main supply track formed on the carrier and is arranged between neighbouring LED modules; and also a plurality of secondary contact pads, each of which can be used to make an electrical connection to a driver, and wherein each secondary contact pad is electrically connected to a secondary supply track formed on the carrier and is arranged on either side of an inner LED module. In the modular LED string, an anode contact of each first LED module is electrically connected to the main supply track, and an anode contact of each remaining LED module is electrically connected to the secondary supply track. The modular LED string is manufactured to permit cutting through an LED module group to remove one or more LED modules from a complete group, so that the cut section can commence with an incomplete LED module group, and so that the cut section can be connected to a driver directly, i.e. without any need for modification.

In some embodiments, the length of the modular LED string (the number of LED modules it contains) can easily be adapted to the requirements of the intended lighting application and that the length of a cut string section is not limited to multiples of the LED module length.

In some embodiments, the LED lighting assembly comprises a driver realized to provide a first positive supply voltage at a first voltage output and to provide a second positive supply voltage at a second voltage output; an LED string section cut from an embodiment of the modular LED string; and at least an electrical connection between the first voltage output and the main contact pad at the cut edge of the cut string section.

The LED lighting assembly according to various ones of the disclosed embodiments may be used in a greater variety of lighting applications, since the driver can be used to drive a cut LED string section that commences with a complete LED module group, or a cut LED string section that commences with an inner LED module or a final LED module. The cost of the added functionality of the driver (to provide the second positive supply voltage) can be outweighed by the savings in manufacturing, as expensive modifications to a cut LED string section order to achieve a non-modular length may be avoided.

In some embodiments, the method of manufacturing such an LED lighting assembly comprises the steps of shortening an embodiment of the modular LED string to remove at least one LED module (e.g., just the first LED module, or the first LED module and also one or more inner LED modules); providing a driver with a first voltage output and a second voltage output; forming an electrical connection between the first voltage output and the main contact pad at the cut edge of the LED string section; and forming an electrical connection between the second voltage output and the secondary contact pad at the cut edge of the LED string section.

In some embodiments, the carrier may be a narrow flexible band or strip onto which the LED modules are mounted. A design feature of such a modular LED string is the ability to create luminaries with different shapes by bending the modular LED string as appropriate. The flexible carrier can be realized as a "flex PCB," i.e., as a flexible printed circuit board primarily comprising a polymer band (e.g., polyimide) or laminated polymer layers upon which copper tracks can be patterned. The LED module components may be soldered directly onto the copper tracks on the flex PCB. Alternatively, the flexible carrier may be a thicker body that can be bent into a desired shape, and which holds its shape after bending. In such an embodiment, the LED modules may be provided as preassembled PCB elements that can be attached to the carrier and connected using thin wires. The LED modules and wiring can be enclosed using a suitable transparent or translucent potting material such as, for example, a polysiloxane to protect the circuit elements from damage, to hermetically seal the circuit, to diffuse the light, etc. This protective material coating can be formed in an over-molding step. The modular LED string may comprise any number of LED modules mounted to such a flexible carrier. The terms "modular LED string" and "LED string" may be used interchangeably in this description.

In the following, but without restricting the disclosure in any way, the flexible carrier may be a "flex PCB" and each LED module comprises a single LED die such as a surface-mount die (SMD) mounted on a small printed circuit board or interposer. An LED module may, in various embodiments, also be assumed to have contact pads on its lower surface, arranged to form interconnects with conductive tracks on a flexPCB, for example. In the following, for the sake of simplicity, the flexible carrier may be provided with conductive tracks to form the series-connections between the LED modules. The three different types of LED module (first, inner, and final) may have appropriate contact pad arrangements, since a first LED module will be connected between the main supply track and the secondary supply track, an inner LED module will be connected between consecutive sections of the secondary supply track, and a final LED module be connected between the secondary supply track and a ground or return track. An LED module can be mounted to the carrier by forming solder interconnects between its contact pads and the conductive tracks of the carrier, for example in a reflow solder process.

The expression "complete LED group" or "complete group" may be used to refer to a series-connected group of LED modules, beginning with a first LED module and ending with a final LED module. The modular LED string may comprise any number of such complete groups, and the groups are connected in parallel. The anodes of all first LED modules may be connected to the main supply track, and the cathodes of all final LED modules are connected to the return track. A complete group may comprise more than one inner LED module. However, in some embodiments, a complete group may comprise a single inner LED module, so that the complete group comprises a total of, for example, three series-connected LED modules. In the following, but without restricting the disclosure in any way, a complete group may comprise three series-connected LED modules as described above. The LED string can be manufactured to comprise any number of such complete groups.

In some embodiments, the modular LED string is manufactured to permit cutting through the carrier and the supply tracks, for example along marked cutting lines. A "group cutting line" can indicate where to cut the modular LED string to obtain a cut string section that commences with a complete group, i.e., the cut string section commences with a first LED module. Another cutting line can indicate where to cut the modular LED string in order to obtain a cut string section that commences with an inner LED module. Another cutting line can indicate where to cut the modular LED string in order to obtain a cut string section that commences with a final LED module. After cutting along such an "inner" cutting line, the resulting cut LED string section may start with an inner LED module or a final LED module, followed by any number of complete groups.

In a flexPCB embodiment that has conductive tracks on its upper surface, the cutting lines may extend midway through a set of contact pads, for example through all three contact pads (main contact pad, secondary contact pad, and return contact pad) in front of the final LED module. The contact pads may be large enough to be solderable after being cut in half, and may have any suitable shape such as an oval shape, a figure-of-eight shape, etc. Such a contact pad may be arranged symmetrically about the cutting line. The length of a contact pad may be significantly longer than the width of the contact pad, so that after cutting through the contact pad, the remaining area (or "half contact pad") is sufficiently large to form a solder connection. In some embodiments, the aspect ratio of a contact pad may be 2:1, i.e., the contact pad is twice as long as it is wide. With these measures, it may be possible to easily connect a cut string section to the driver, as it may be straightforward to solder leads to the favorably large half contact pads.

Alternatively, the cutting lines may be positioned to one side of the contact pads so that cutting does not affect the contact pads, which remain on the carrier. In an embodiment in which the LED modules are connected by wires, the cut ends of the wires may simply be used to form the electrical connections to the driver. The driver of a modular LED string may be generally realized to provide a voltage difference across the parallel-connected LED module groups, which voltage difference is at least the sum of the forward voltages of the series-connected LEDs of a group. To connect the main positive supply voltage to each complete LED module group, the main supply track may extend along the length of the carrier and can be connected via any main contact pad to the first voltage output of the driver. To connect each LED module group to ground, the carrier may be patterned with a return track that can be connected via any return contact pad to the negative supply voltage. The return track or ground track can extend along the length of the carrier. The cathode of each final LED module may be electrically connected to the return track.

To achieve a series-connection between the first LED module and the inner LED module of a complete group, and to achieve a series-connection between an inner LED module and the final LED module, the secondary supply track may be patterned as a number of successive sections, which may be arranged in line with each other and separated by gaps. In the case of a modular LED string in which complete groups each comprise a total of three LED modules, the secondary supply track may comprise two sections for each group. For a complete group, the first section of the secondary supply track may be electrically connected at one end to the cathode contact of the first LED module, and at its other end to the anode contact of the inner LED module; the second section of the secondary supply track may be electrically connected at one end to the cathode contact of the inner LED module, and at its other end to the anode of the final LED module.

In the approach, any section of the secondary supply track can be connected via a secondary contact pad to the secondary voltage output of the driver. In this way, when the cut string section commences with an inner LED module or a final LED module, the LED lighting assembly may comprise an electrical connection between the second voltage output and the secondary contact pad at the cut edge of the shortened modular LED string. In this way, the anode of the inner LED module (or final LED module) can easily be connected to a suitable supply voltage that is lower than the primary supply voltage. The secondary supply voltage may be lower than the primary supply voltage to drive a complete string of LED modules.

As explained above, the modular LED string can be cut to obtain a string section of the desired length. Assuming M LED modules in each complete group, the length of a cut string section can be expressed as $$L=mL_M+nL_G \text{ for } 0<m<M \text{ and } n\geq 1 \quad (1)$$

where $L_M$ is the length of an LED module, m is the number of LED modules in the incomplete group, $L_G$ is the length of a complete group, and n is the number of complete groups attached to the incomplete group. With an LED module length of, for example, 10 mm, a complete group may be 30 mm in length. A cut string section can then comprise an integer multiple of 30 mm, with an additional 10 mm or 20 mm. In this way it is possible to cut an LED strip to a length of 40 mm, 70 mm, 110 mm, etc, unlike other modular LED strings that can only be cut between complete groups, and for which the length of a cut string section can be expressed as $$L=nL_G \text{ for } n\geq 1 \quad (2)$$

where $L_G$ is the length of a complete group, and n is the number of complete modules in the strip after cutting. This is unlike LED modules in which it is only possible to cut an LED strip to a length of 30 mm, 60 mm, 90 mm, etc., when a complete group has a length of 30 mm.

When a cut string section commences with a complete LED group, the second voltage output of the LED lighting assembly may not be connected to the cut string section, i.e., this voltage output of the driver is left open. To drive the complete LED groups of the cut string section, the driver may provide the primary supply voltage at the first voltage output. To be able to drive a cut string section commencing with an incomplete or shortened group, the driver may be realized to further provide a secondary supply voltage at the second voltage output. To be able to adjust to the LED count of a cut string section, the driver may be a programmable driver or a self-adjusting driver. The number of parallel-connected LEDs in complete groups may be relevant to the primary voltage output, while the number of series-connected LEDs in the first string section may be relevant to the secondary voltage output. An adjustable current-regulated power-source may be used to provide the primary voltage output. The driver may comprise a current-regulated source to provide the secondary voltage, so that re-configuring of the driver may be avoided if the first string section has been cut. Other objects and features of the present application will become apparent from the following detailed descriptions considered in conjunction with the accompanying drawings. It is to be understood, however, that the drawings are designed solely for the purposes of illustration and not as a definition of the limits of the disclosed subject matter.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

In the following description, numerous specific details are set forth, such as particular structures, components, materials, dimensions, processing steps, and techniques, in order to provide a thorough understanding of the present embodiments. However, it will be appreciated by one of ordinary skill of the art that the embodiments may be practiced without these specific details. In other instances, well-known structures or processing steps have not been described in detail in order to avoid obscuring the embodiments. It will be understood that when an element such as a layer, region, or substrate is referred to as being "on" or "over" another element, it can be directly on the other element or intervening elements may also be present. In contrast, when an element is referred to as being "directly on" or "directly" over another element, there are no intervening elements present. It will also be understood that when an element is referred to as being "beneath," "below," or "under" another element, it can be directly beneath or under the other element, or intervening elements may be present. In contrast, when an element is referred to as being "directly beneath" or "directly under" another element, there are no intervening elements present.

In the interest of not obscuring the presentation of embodiments in the following detailed description, some processing steps or operations that are known in the art may have been combined together for presentation and for illustration purposes and in some instances may have not been described in detail. In other instances, some processing steps or operations that are known in the art may not be described at all. It should be understood that the following description is rather focused on the distinctive features or elements of various embodiments described herein.

Figure 1:
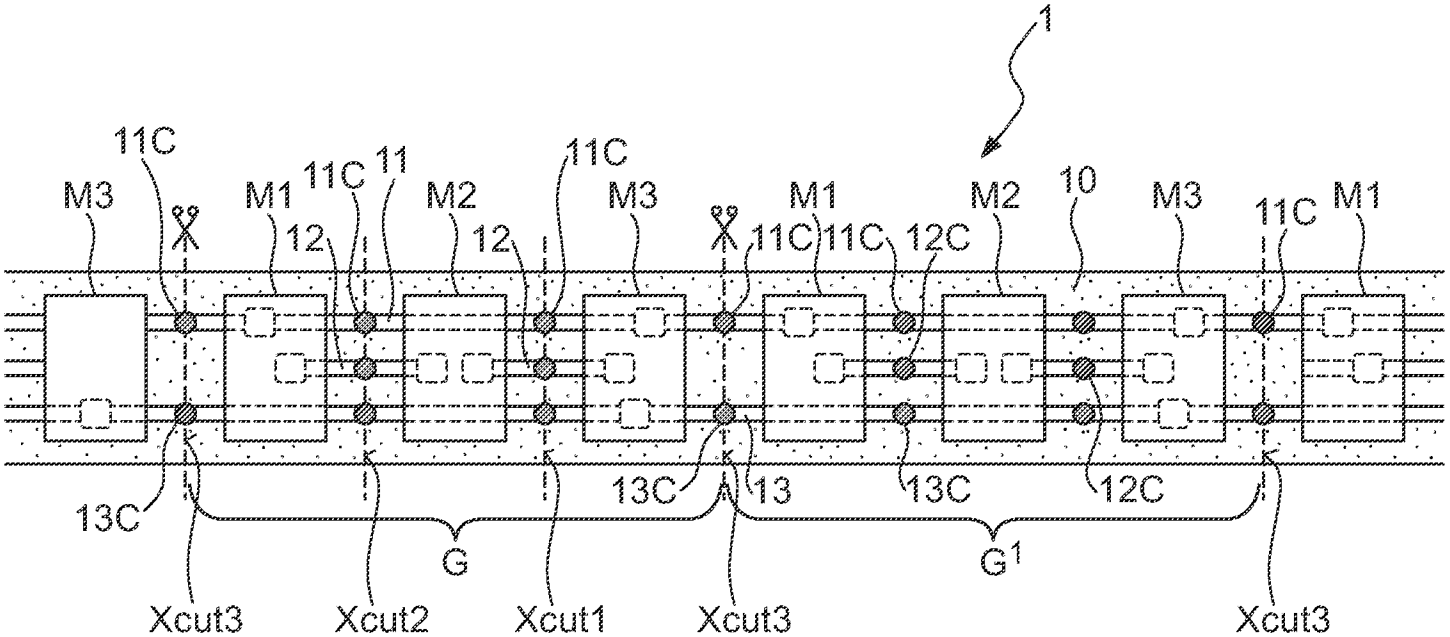
FIG. 1 shows a modular LED string, according to some embodiments.
Figure 2:
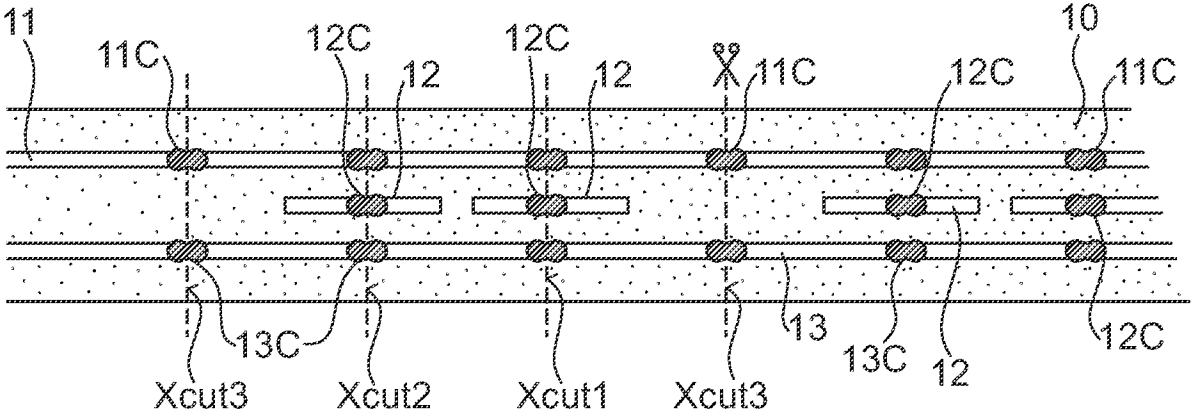
FIG. 2 shows a pattern of conductive tracks on a carrier of the modular LED string of FIG. 1, according to some embodiments.

FIG. 1 shows an embodiment of a modular LED string 1. The drawing shows a flexible carrier 10, which can for example be made of a material such as polyimide. Several conductive tracks 11, 12, 13 have been patterned onto the carrier 10, for example by etching from, for example, a copper layer, or by printing. FIG. 2 shows a carrier 10 with such a pattern of the conductive tracks 11, 12, 13. These tracks comprise a main supply track 11 for connection to a primary power supply; secondary supply track sections 12 which are used to serially connect the LEDs in sequence and which can be connected to a secondary power supply; and a return track 13 for connection to a negative power terminal or ground.

FIG. 1 also shows groups G of LED modules M1, M2, M3 attached to the carrier by interconnects (e.g., solder bonds) between contact pads of the LED modules M1, M2, M3 and the conductive tracks. Each LED module M1, M2, M3 comprises an SMD LED soldered to a small PCB or interposer which has been prepared with vias and conductive tracks for connecting the anode of the LED die to an anode contact pad, and for connecting the cathode of the LED die to a cathode contact pad. In this embodiment, each group G comprises three LED modules M1, M2, M3, namely a first LED module M1, an inner LED module M2, and a final LED module M3

Figure 3:
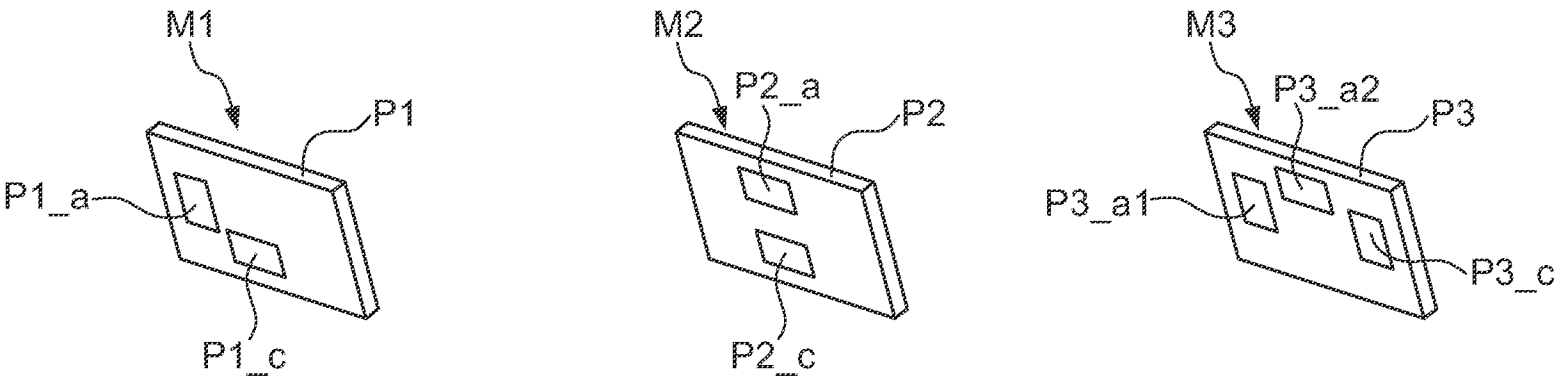
FIG. 3 shows the undersides of LED modules of the modular LED string of FIG. 1, according to some embodiments.
Figure 4:
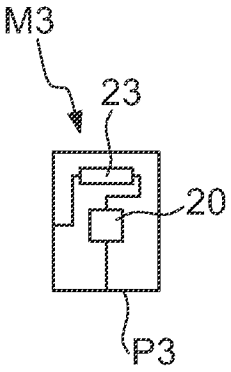
FIG. 4 shows LED modules of the modular LED string of FIG. 1, according to some embodiments.

FIG. 3 shows the undersides of the interposers P1, P2, P3 of the LED modules M1, M2, M3 to indicate the different contact pads required for the different LED modules M1, M2, M3. FIG. 4 shows the circuit components of each LED module M1, M2, M3. To connect the first LED module M1 to a primary power supply, an anode contact pad P1_*a* is arranged for a solder interconnect to the main supply track 11. A resistor 21 is arranged in series between the anode contact pad P1_*a* and the LED 20 of the first LED module M1. The first LED module M1 also has a cathode contact pad P1_*c* arranged for a solder interconnect to a secondary supply track section 12.

To connect the first LED module M1 in series with the inner LED module M2, or to connect the inner LED module M2 directly to the secondary power supply, the inner LED module M2 has an anode contact pad P2_*a* arranged for a solder interconnect to a secondary supply track section 12. In this embodiment, a resistor 22 is arranged in series between the anode contact pad P2_*a* and the LED 20 of the inner LED module M2. The inner LED module M2 also has a cathode contact pad P2_*c* arranged for a solder interconnect to the next secondary supply track section 12.

To connect the inner LED module M2 in series with the third LED module M3, an anode contact pad P3_*a* is arranged for a solder interconnect to the secondary supply track section 12. The cathode contact pad P3_*c* of the third LED module M3 is arranged for a solder interconnect to the return track 13.

The modular LED string 1 can be cut between groups G along cutting lines $X_{cut3}$ so that a shorter piece comprising an integer number of groups G can be cut from the long strip 1. The modular LED string 1 (as shown in FIG. 1 and FIG. 2) can also be cut between LED modules M1, M2, M3 along cutting lines $X_{cut2}$, $X_{cut1}$, so that a section of carrier with any number of LED modules can be cut from a long strip. However, instead of then carrying out modifications to be able to drive the shortened section correctly, the modular LED string 1 is provided with strategically placed contact pads. As shown in FIG. 1 and FIG. 2, main contact pads 11C are provided between adjacent LED modules M1, M2, M3, so that the primary power supply can always be connected to the main supply track 11, regardless of where the LED string 1 is cut. Secondary contact pads 12C are provided on both sides of every inner LED module M2, so that the secondary power supply can always be connected to a secondary supply track section 12, regardless of where the LED string 1 is cut. Return contact pads 13C are provided between adjacent LED modules M1, M2, M3, so that a negative or return voltage can always be connected to the return track 13, regardless of where the LED string 1 is cut. FIG. 2 indicates a shape for the contact pads 11C, 12C, 13C in some embodiments, in this case, a figure-of-eight shape.

Figure 5:
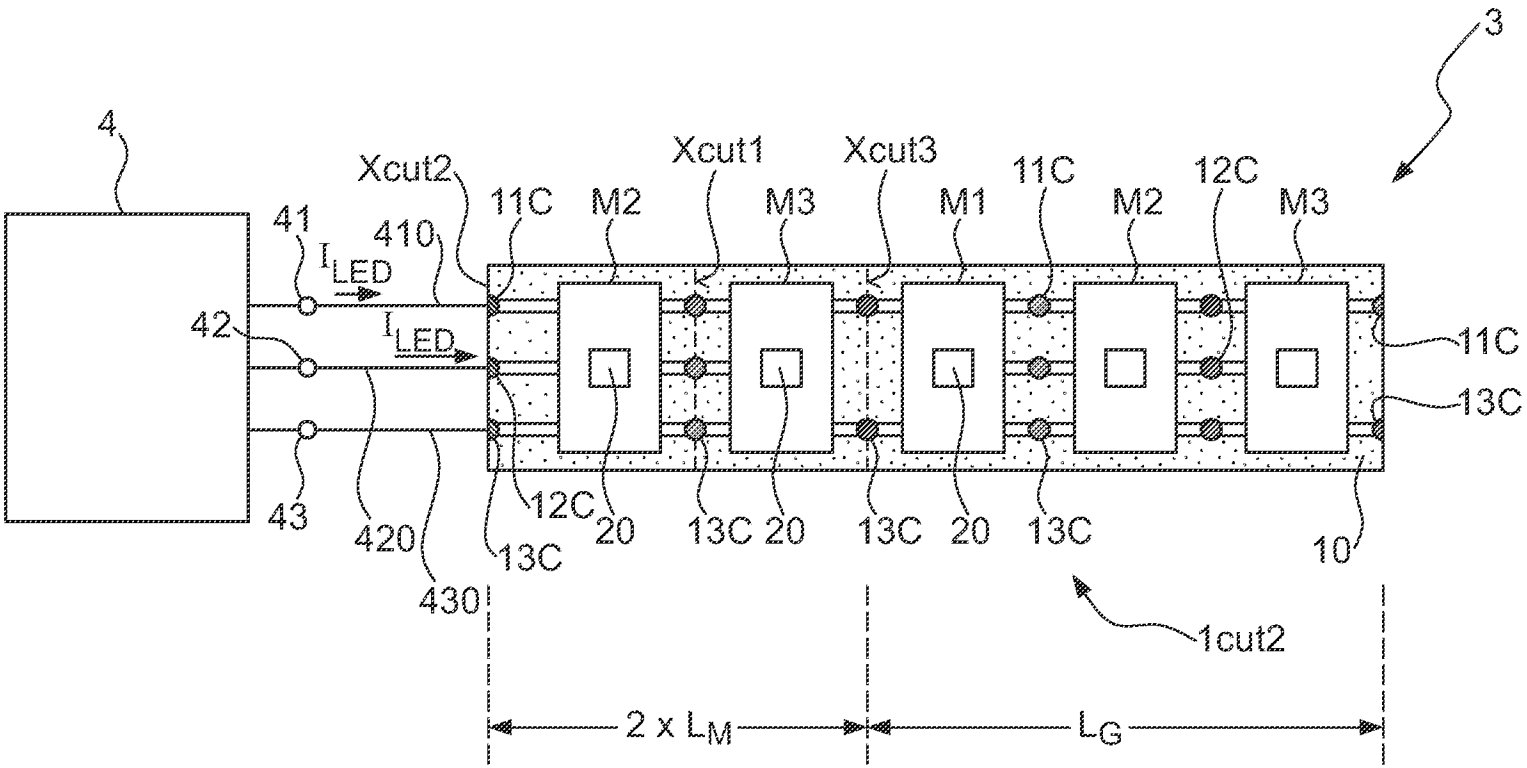
FIG. 5 shows an LED lighting assembly, according to some embodiments.

FIG. 5 shows a first embodiment of an LED lighting assembly 3. FIG. 5 shows a constant current driver 4 connected to a cut section $\mathbf{1}_{cut2}$ of the modular LED string 1 described in FIGS. 1-4. In this embodiment, the driver 4 is an adjustable or self-adjusting (current-limiting) driver.

In this embodiment, the modular LED string section $\mathbf{1}_{cut2}$ has been cut along cutting line $X_{cut2}$ so that section $\mathbf{1}_{cut2}$ commences with an incomplete group, i.e. with the inner LED module M2 of a two-module shortened group. The cut section $\mathbf{1}_{cut2}$ can comprise any number of further complete groups G, and only one such group is shown here as an example. The total length of the cut section $\mathbf{1}_{cut2}$ in this example is $L_G+2L_M$, and is not constrained to a length of n×which would be the case using other LED string, which can only be cut between complete groups.

The driver 4 may be realized to provide a primary voltage at a first voltage output 41, and to provide a secondary voltage at a second voltage output 42. The driver 4 may also provide a negative voltage or ground at a return terminal 43. The primary voltage may be at a level that is suitable to drive complete groups G and may be connected via the main contact pad 11C at the cut edge of the shortened group to the anodes of the first LED modules M1 of any complete group G of the cut section $\mathbf{1}_{cut2}$. In this embodiment, the cut section $\mathbf{1}_{cut2}$ comprises a two-module shorted group (LED modules M2, M3) and a complete group, i.e. five LED modules in total in this example. The secondary voltage may be at a level that is suitable to drive a shortened group and will be connected, via the secondary contact pad 12C at the cut edge of the shortened group, to the anode of an inner LED module M2. The driver 4 may be realized to provide essentially the same current level $I_{LED}$ at each voltage output 41, 42 when connected to a load. The return voltage may be at ground level or a suitable negative voltage level, and may be connected via the return contact pad 13C at the cut edge of the shortened group to the cathodes of the final LED modules M3 of the cut section $\mathbf{1}_{cut2}$.

The anode of the inner LED module M2 may be connected via the secondary contact pad 12C to the secondary voltage output 42 of the driver 4 by means of an electrical connection 420. The primary voltage output 41 may be connected via the main contact pad 11C to the main supply track 11 of the cut section $\mathbf{1}_{cut2}$ by means of an electrical connection 410, and the return terminal 43 may be connected via the return contact pad 13C to the return track 13 by means of an electrical connection 430.

Figure 6:
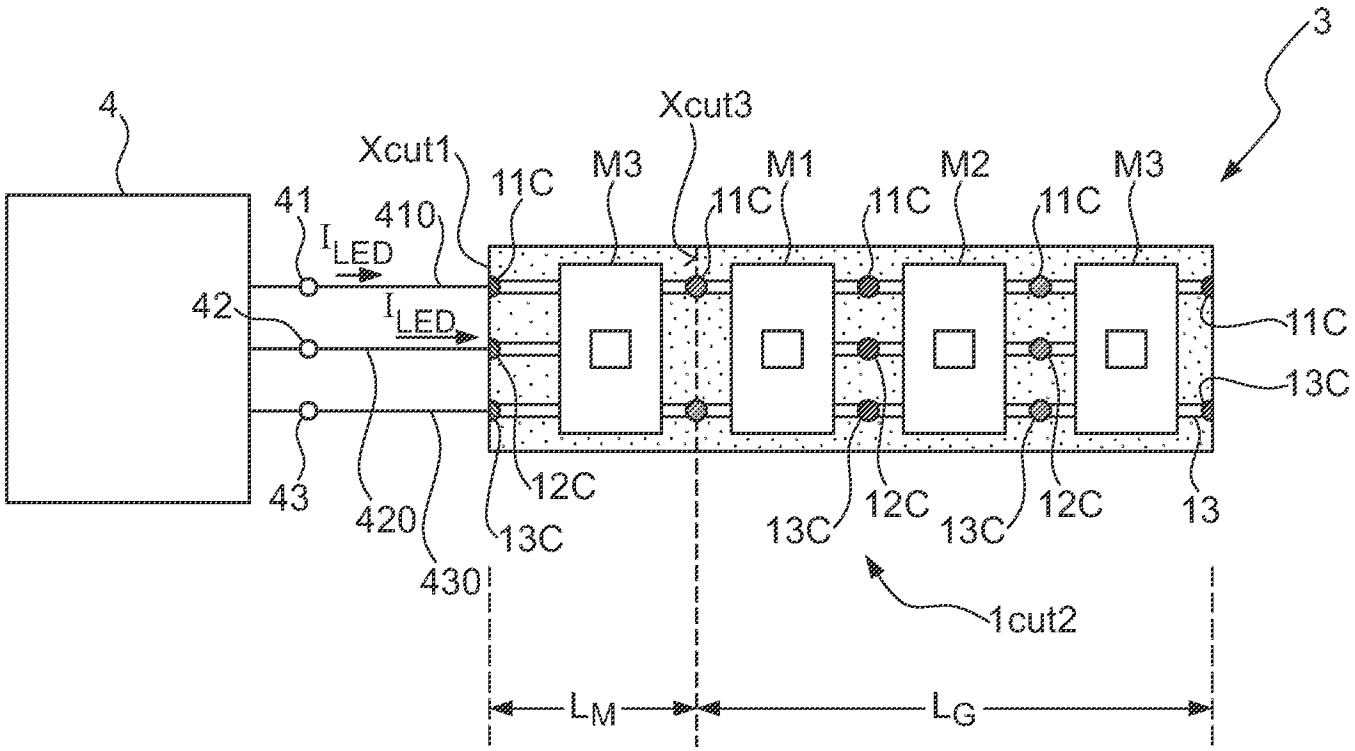
FIG. 6 shows an LED lighting assembly, according to some embodiments.

FIG. 6 shows another embodiment of the LED lighting assembly 3, with the same driver 4 as described in FIG. 5. In this embodiment, the cut section $\mathbf{1}_{cut1}$ has been cut along cutting line $X_{cut1}$ so that the cut section $\mathbf{1}_{cut1}$ consists of only one LED module, i.e., the final LED module M3. The cut section $\mathbf{1}_{cut1}$ can continue with any number of further complete groups G, and only one complete group is shown here as an example. The total length of the cut section $\mathbf{1}_{cut1}$ is $L_G+L_M$.

The primary voltage output 41 may be connected, via the main contact pad 11C at the cut edge of the shortened group, to the main supply track 11 of the cut section $\mathbf{1}_{cut1}$. As explained with reference to FIG. 4, the anode of the final LED module M3 may be connected via the secondary contact pad 12C at the cut edge of the shortened group, to the secondary voltage output 42 of the driver 4 by means of an electrical connection 420. The cathodes of all final LED modules M3 may be connected to the return track 13, which may be connected, via the return contact pad 13C at the cut edge of the shortened group, to the return terminal 43 by means of an electrical connection 430.

Figure 7:
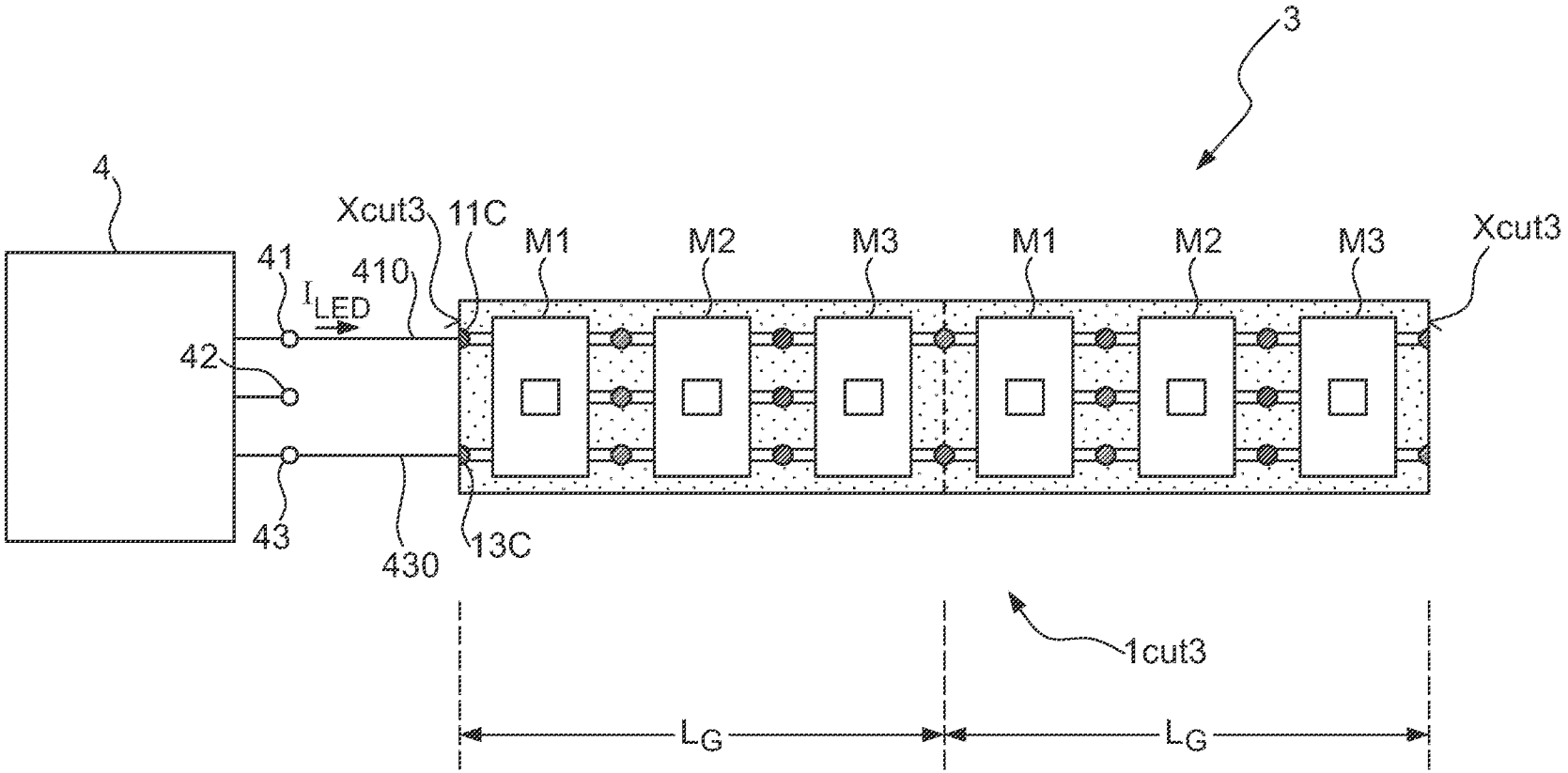
FIG. 7 shows an LED lighting assembly, according to some embodiments.

FIG. 7 shows another embodiment of the LED lighting assembly 3. In this embodiment, the cut section $\mathbf{1}_{cut3}$ has been cut along cutting line $X_{cut3}$ so that the cut section $\mathbf{1}_{cut3}$ commences with a complete group G. The cut section $\mathbf{1}_{cut3}$ can continue with any number of further complete groups G. Any suitable driver that is realized to provide a suitable voltage difference can be connected across the main supply track 11 and the return track 13. Alternatively, it is possible to use the same driver 4 as described in FIG. 5 and FIG. 6 above, in which case use of the secondary voltage output 42 may be avoided and can be left unconnected or open.

Although the present disclosed subject matter has been disclosed in the form of preferred embodiments and variations thereon, it will be understood that numerous additional modifications and variations could be made thereto without departing from the scope of the disclosed subject matter.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE LABELS

LED string assembly 1
cut LED string section $\mathbf{1}_{cut2}$, $\mathbf{1}_{cut1}$, $\mathbf{1}_{cut3}$
carrier 10
main supply track 11
main contact pad 11C
secondary supply track 12
secondary contact pad 12C
return supply track 13
return contact pad 13C
LED 20
resistor 21, 22, 23
driver 4
supply voltage terminal 41
supply voltage terminal 42
return terminal 43
electrical connection 410, 420, 430
complete groups G
LED modules M1, M2, M3
cutting line $X_{cut3}$, $X_{cut2}$, $X_{cut1}$
contact pad P1_*a*, P1_*c*
contact pad P2_*a*, P2_*c*
contact pad P3_*a*, P3_*c*
LED module length $L_M$
group length $L_G$ Although features and elements are described above in particular combinations, one of ordinary skill in the art will appreciate that each feature or element can be used alone or in any combination with the other features and elements. In addition, the methods described herein may be implemented in a computer program, software, or firmware incorporated in a computer-readable medium for execution by a computer or processor. Examples of computer-readable media include electronic signals (transmitted over wired or wireless connections) and computer-readable storage media. Examples of computer-readable storage media include, but are not limited to, a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

Having described the disclosed subject matter in detail, those skilled in the art will appreciate that, given the present disclosure, modifications may be made thereto without departing from the disclosed subject matter described herein. Therefore, it is not intended that the scope of the disclosed subject matter be limited to the specific embodiments illustrated and described.

What is claimed is:

1. A modular LED string comprising:

a plurality of LED module groups mounted on a carrier, each LED module group comprising a series-connected row of LED modules commencing with a first LED module followed by an inner LED module and terminated by a final LED module;

a plurality of main contact pads configured to be coupled to an external electrical contact, each main contact pad electrically coupled to a main supply track formed on the carrier and arranged between neighboring LED modules of each LED module group;

a plurality of secondary contact pads configured to be coupled to another external electrical contact, each secondary contact pad electrically coupled to a secondary supply track formed on the carrier and arranged on either side of the inner LED module of each LED module group, an anode contact of each first LED module being electrically coupled to the main supply track and an anode contact of each inner LED module and each final LED module being electrically coupled to the secondary supply track, each LED module group separable anywhere between each LED module within the LED module group such that LED modules remaining after separation are drivable without addition of corrective circuitry and without addition of a supplemental LED circuit portion; and a plurality of return contact pads, each return contact pad being electrically coupled to a return supply track formed on the carrier and arranged between neighboring LED modules of each LED module group, each return track extending along an entire length of the carrier and provided for connection, via a return contact pad, to a negative supply voltage.

2. A modular LED string according to claim 1, wherein the main supply track extends along the entire length of the carrier and is provided for connection, via a main contact pad, to a primary supply voltage.

3. A modular LED string according to claim 1, wherein:

the secondary supply track comprises a number of unconnected sections arranged to lie on either side of the inner LED module of each LED module group, and each secondary supply track section is provided for connection, via a secondary contact pad, to a secondary supply voltage.

4. A modular LED string according to claim 1, wherein the first LED module of one of the LED module groups comprises a cathode contact electrically coupled to a secondary supply track section.

5. A modular LED string according to claim 1, wherein the anode contact of one of the inner LED modules of one of the LED module groups is electrically coupled to a secondary supply track section, and a cathode contact of the one of the inner LED modules is electrically coupled to a consecutive secondary supply track section.

6. A modular LED string according to claim 1, wherein the anode contact of the final LED module of one of the LED module groups is electrically coupled to a secondary supply track section.

7. A modular LED string according to claim 1, wherein one of the LED module groups comprises a single inner LED module.

8. A modular LED string according to claim 1, wherein one of the LED module groups comprises a single LED die mounted on a printed circuit board.

9. A modular LED string according to claim 1, wherein the carrier and the main and secondary supply tracks are manufactured to permit cutting of the modular LED string along predefined cutting lines to obtain any of:

a first cut LED string section commencing with a first LED module of a particular LED module group;

a second cut LED string section commencing with the inner LED module of the particular LED module group; and a third cut LED string section commencing with a final LED module of the particular LED module group.

10. A modular LED string according to claim 1, wherein the carrier and the main supply track and the secondary supply track are manufactured to permit cutting of the modular LED string along predefined cutting lines to obtain a cut string section having a length of about:

$$L=mL_M+nL_G \text{ for } 0<m<M \text{ and } n\geq 1$$

where $L_M$ is a length of each LED module, m is a number of LED modules in an incomplete LED module group, $L_G$ is a length of a complete LED module group, and n is a number of complete LED module groups attached to the incomplete LED module group.

11. A modular LED string according to claim 1, wherein each LED module group has a same number of LED modules.

12. An LED lighting assembly comprising:

a driver configured to provide a first positive supply voltage at a first voltage output and to provide a second positive supply voltage at a second voltage output;

a cut LED string section cut from a modular LED string that comprises:

a plurality of LED module groups mounted on a carrier, each LED module group comprising a series-connected row of LED modules commencing with a first LED module followed by an inner LED module and terminated by a final LED module;

a plurality of main contact pads configured to be coupled to an external electrical contact, each main contact pad electrically coupled to a main supply track formed on the carrier and arranged between neighboring LED modules of each LED module group; and a plurality of secondary contact pads configured to be coupled to another external electrical contact, each secondary contact pad electrically coupled to a secondary supply track formed on the carrier and arranged on either side of the inner LED module of each LED module group, an anode contact of each first LED module being electrically coupled to the main supply track and an anode contact of each inner LED module and each final LED module being electrically coupled to the secondary supply track, each LED module group separable anywhere between each LED module within the LED module group such that LED modules remaining after separation are drivable without addition of corrective circuitry and without addition of a supplemental LED circuit portion; and an electrical connection between the first voltage output and a main contact pad at a cut edge of the cut LED string section.

13. An LED lighting assembly according to claim 12, wherein:

the cut LED string section commences with a shortened LED module group, and the LED lighting assembly further comprises an electrical connection between the second voltage output and a secondary contact pad at a cut edge of the shortened LED module group.

14. An LED lighting assembly according to claim 12, wherein:

the cut LED string section commences with a complete LED module group, and the second voltage output of the driver is not connected to the cut LED string section.

15. An LED lighting assembly according to claim 12, wherein:

the driver is configured to provide a negative supply voltage at a return voltage terminal, and the LED lighting assembly comprises an electrical connection between the return voltage terminal and a return contact pad at the cut edge of the LED string section.

16. A method of manufacturing an LED lighting assembly, the method comprising:

cutting an LED string section from a modular LED string to remove at least a first LED module, the modular LED string comprising:

a plurality of LED module groups mounted on a carrier, each LED module group comprising a series-connected row of LED modules commencing with a first LED module followed by an inner LED module and terminated by a final LED module;

a plurality of main contact pads configured to be coupled to an external electrical contact, each main contact pad electrically coupled to a main supply track formed on the carrier and arranged between neighboring LED modules of each LED module group; and a plurality of secondary contact pads configured to be coupled to another external electrical contact, each secondary contact pad electrically coupled to a secondary supply track formed on the carrier and arranged on either side of the inner LED module of each LED module group, an anode contact of each first LED module being electrically coupled to the main supply track and an anode contact of each inner LED module and each final LED module being electrically coupled to the secondary supply track, each LED module group separable anywhere between each LED module within the LED module group such that LED modules remaining after separation are drivable without addition of corrective circuitry and without addition of a supplemental LED circuit portion;

obtaining a driver configured to provide a first positive supply voltage at a first voltage output and to provide a second positive supply voltage at a second supply voltage output;

forming a first electrical connection between the first voltage output and a main contact pad at a cut edge of the LED string section;

forming a second electrical connection between the second voltage output and a secondary contact pad at the cut edge of the LED string section; and forming a third electrical connection between a return voltage terminal and a return contact pad at the cut edge of the LED string section.

17. A method of manufacturing an LED lighting assembly according to claim 16, wherein cutting an LED string section from a modular LED string to remove at least a first LED module comprises cutting the modular LED string along predefined cutting lines to obtain a cut string section having a length of about:

$L=mL_M+nL_G$ for $0<m<M$ and $n\geq 1$ where $L_M$ is a length of each LED module, m is a number of LED modules in an incomplete LED module group, $L_G$ is a length of a complete LED module group, and n is a number of complete LED module groups attached to the incomplete LED module group.

* * * * *